United States Patent [19]

Calhoun et al.

[11] 4,276,937

[45] Jul. 7, 1981

[54] WELL SAFETY SYSTEM

[75] Inventors: Michael B. Calhoun; Russell I. Bayh, III, both of Carrollton, Tex.; Robert E. Dutton, Aurora, Colo.

[73] Assignee: Otis Engineering Corporation, Dallas, Tex.

[21] Appl. No.: 9,869

[22] Filed: Feb. 7, 1979 (Under 37 CFR 1.47)

[51] Int. Cl.[3] ..... E21B 43/12

[52] U.S. Cl. ..... 166/323; 251/58; 251/62

[58] Field of Search ..... 166/321, 322, 323, 324; 251/58, 62, 63.5; 137/495, 522, 629

[56] References Cited

U.S. PATENT DOCUMENTS

| | | | |
|---|---|---|---|
| 3,065,794 | 11/1962 | Page | 166/72 |
| 3,208,531 | 9/1965 | Tamplen | 166/125 |
| 3,273,588 | 9/1966 | Dollison | 137/460 |
| 3,375,874 | 4/1968 | Cherry et al. | 166/321 |
| 3,459,260 | 8/1969 | Dollison | 166/216 |
| 3,870,104 | 3/1975 | Mott | 166/323 |
| 3,882,935 | 5/1975 | Calhoun | 166/322 |
| 4,005,751 | 2/1977 | Page, Jr. | 166/321 |
| 4,049,052 | 9/1977 | Arendt | 166/321 |
| 4,069,871 | 1/1978 | Page, Jr. | 166/321 |
| 4,086,935 | 5/1978 | Raulins et al. | 137/522 |

*Primary Examiner*—James A. Leppink

*Attorney, Agent, or Firm*—Thomas R. Felger

[57] ABSTRACT

A well safety system for controlling the flow of fluid through well conduits. The system includes a surface controlled subsurface safety valve made up as part of a tubing string extending from the well surface to a subsurface formation within a casing string. A packer, installed below the safety valve, forms a fluid tight seal between the tubing and casing to direct fluid from below the packer into the tubing. The safety valve contains lateral passageways which allow communication of fluid from the bore of the safety valve to the annulus between the tubing and casing above the packer. A valve actuator is releasably secured within the upper portion of the safety valve and forms a fluid tight seal between control fluid pressure in the tubing string above the safety valve and formation fluid pressure in the tubing string below the safety valve. The safety valve can be locked open when control pressure is increased above a preselected value and then released. The safety valve can be unlocked by returning control pressure to another preselected value. The valve actuator allows liquids to be injected from the surface to below the safety valve to kill the well. The tubing and seals within the valve actuator can be pressure tested when the valve actuator is initially installed within the safety valve without opening the safety valve.

17 Claims, 27 Drawing Figures

WELL SAFETY SYSTEM

BACKGROUND OF THE INVENTION

1. Field of the Invention

This invention relates to surface controlled subsurface safety valves for use in wells having a tubing string disposed within a casing string.

2. Description of the Prior Art

Surface controlled subsurface safety valves utilized in well installations are well known. Such valves are normally biased towards a closed position and held open by hydraulic fluid pressure or control pressure from the well surface. The hydraulic or control fluid may either be liquid or gas.

A typical valve is shown in U.S. Pat. No. 4,086,935 to George M. Raulins, et al, in which control pressure acts on a sliding seal or piston to overcome a spring and open the valve closure means. The valve is made up as part of the production tubing string having a common longitudinal bore. Thus, opening and closing the valve closure means controls fluid flow through the production tubing string.

Many wells have a casing string with a production tubing string disposed therein. Sometimes it is desirable to produce formation fluids through both the tubing and the annulus between the tubing and casing. U.S. Pat. No. 4,049,052 discloses an annulus safety valve to control flow in the annulus between tubing and casing and may include a tubing safety valve to control flow within the tubing.

U.S. Pat. No. 3,375,874 to V. R. Cherry, et al, discloses a subsurace safety valve particularly adapted for use in gas storage wells. The safety valve disclosed in U.S. Pat. No. 3,375,874 requires a special conduit to direct control fluid from the well surface to the safety valve. The valve actuating means within the safety valve is not wireline retrievable. Both the tubing and the safety valve must be withdrawn from the well to repair a damaged seal within the actuating means shown in U.S. Pat. No. 3,375,874.

The present invention is shown as a safety valve particularly adapted for use in gas storage wells with gas used as the control fluid. The present invention can be easily modified for use in any oil or gas well with either gas or liquid as the control fluid.

SUMMARY OF THE INVENTION

This invention provides a well safety system comprising a surface controlled subsurface safety valve, a valve actuating means which can be installed and retrieved from the safety valve, a valve closure means which controls fluid communication from tubing below the safety valve to the exterior of the safety valve, means for pressure testing the valve actuating means, means for injecting liquids from the well surface through the valve actuating means, and means for locking open and unlocking the valve closure means in response to changes in control fluid pressure.

One object of the present invention is to provide a surface controlled subsurface safety valve for use in gas storage wells with optimum flow characteristics when gas is being injected into and withdrawn from the underground reservoir.

Another object of the present invention is to provide a surface controlled subsurface safety valve which can be opened when control fluid pressure reaches a first predetermined value, locked open when control fluid pressure is increased to a second higher predetermined value and then released, and unlocked when control fluid pressure is again increased to the first predetermined value.

Still another object of the present invention is to provide a safety valve in which the valve closure means and valve operating means are tubing retrievable and the valve actuating means is wireline retrievable.

One object of the present invention is to provide a well safety system which allows fluid flow through the annulus between the tubing and casing above the safety valve when the safety valve is open.

An additional object of the present invention is to provide a safety valve having a valve actuating means with a gas chamber to assist in closing the valve closure means when control fluid pressure drops below a preselected value. The valve actuating means can be easily retrieved by standard wireline techniques to repair any damaged seals.

Another object of the present invention is to provide a safety valve having a valve actuating means through which liquids can be injected from the well surface to kill the well.

A further object of the present invention is to provide an automatic latching mechanism for the valve actuating means which will allow pressure testing of the control fluid conduit from the well surface to the valve actuating means without opening the valve closure means.

An additional object of the present invention is to provide a safety valve in which the valve closure means can be locked open, the valve actuating means removed, and standard wireline operations conducted through the bore of the safety valve.

Other objects and advantages of the present invention will become readily apparent to those skilled in the art from reading the following description in conjunction with the accompanying drawings illustrating various embodiments of the present invention.

WRITTEN DESCRIPTION OF THE PREFERRED EMBODIMENTS

Figure 1A:
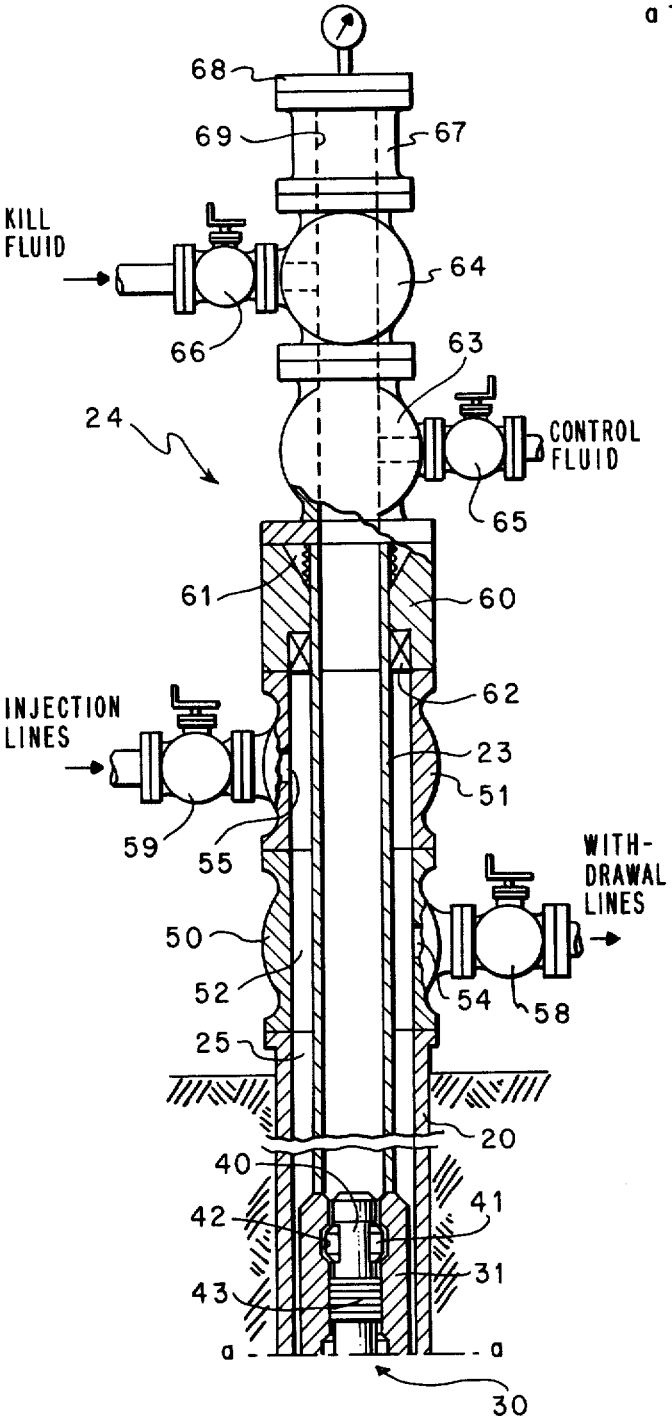
FIGS. 1A and 1B are schematic views partially in section and partially in elevation of the well safety system of the present invention.
Figure 1B:
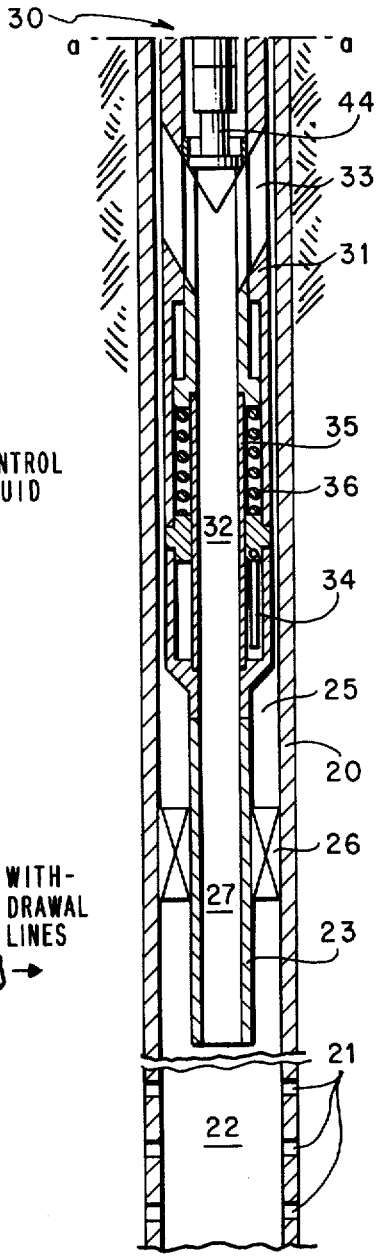

Referring to the drawings and particularly to FIGS. 1A and 1B, a schematic view of the well safety system of the present invention is shown. Casing 20 is disposed within the well bore and extends from the surface to a subsurface formation (not shown). Perforations 21 allow communication of fluids between the bore 22 of casing 20 and the subsurface formation.

Tubing string 23 is disposed within casing string 20 and partially supported by wellhead 24. Annulus 25 is formed between the tubing 23 and casing 20. Packer 26 forms a fluid tight seal between tubing 23 and casing 20 within annulus 25. Packer 26 directs fluid flow through bore 27 of tubing 23.

Surface controlled subsurface safety valve 30 is made up as part of tubing 23 intermediate the ends thereof. Outer housing 31 of safety valve 30 has a longitudinal bore 32 concentric with and communicating with bore 27 of tubing 23. Lateral passageways 33 penetrate outer housing 31 intermediate the ends thereof and allow fluid communication between annulus 25 and bore 32 of the safety valve 30. Thus fluids can communicate between annulus 25 and the subsurface formation (not shown) by flowing through lateral passageways 33, bore 32, tubing 23 and perforations 21.

A valve closure means 34, contained within outer housing 31, is shown in its first position allowing unrestricted flow through bore 32 of safety valve 30. Operating tube 35 is slidably disposed within bore 32 and is shown in its first position opening valve closure means 34.

The valve closure means shown in FIG. 1B is the flapper type. U.S. Pat. No. 3,273,588 to W. W. Dollison discloses that an operating means such as operating tube 35 can be used to open and close various valve closure means including ball, poppet and flapper types. U.S. Pat. No. 3,273,388 is incorporated by reference for all purposes in this written description. The present invention can be readily adapted for use in ball and poppet type safety valves.

Means for actuating safety valve 30 are releasably secured within the upper portion of bore 32 by dogs 41 engaging recess 42 formed in the inside diameter of outer housing 31. Seal means 43 are carried on the exterior of valve actuator or actuating means 40 and provide a fluid tight seal with the inside diameter of outer housing 31. Therefore, seal means 43 prevent fluid within tubing 23 above safety valve 30 from commingling with fluid flowing through lateral passageways 33 and the lower portion of bore 32.

Actuating means 40 includes an actuator linkage 44 which contacts operating tube 35 to move operating tube 35 to its first position compressing spring 35. As will be later described, spring 36 comprises part of the resilient means which moves valve closure means 34 from its first position to its second position blocking fluid flow through bore 32.

Wellhead 24 in FIG. 1A is a schematic representation of the present invention for use in gas storage wells. Flow spools 50 and 51 are attached to casing 20 at the well surface. Each spool has a longitudinal bore concentric with bore 22 of casing 20. Tubing 23 extends through the longitudinal bores of spools 50 and 51 and forms an annulus 52 in communication with annulus 25. Spool 50 contains flow port 54 opening into annulus 52. Spool 51 has a similar flow port 55. When the present invention is used as a gas storage well, flow valve 58 can be opened to allow withdrawal of gas from annulus 52 and 25 through port 54. Similarly, flow valve 59 can be opened to allow injection of gas from a source (not shown) into annulus 52 and 25.

Tubing hanger 60 is attached to the upper flow spool 51 and partially supports the weight of tubing 23 within casing 20. Tubing hanger 60 contains a bore aligned with the bores of spools 50, 51 and casing 20. Slips 61 are carried within the bore of hanger 60 to grip the top section of tubing 23. Seal 62 is also carried within the bore of hanger 60 to form a fluid tight barrier with the outside diameter of tubing 23 preventing pressurized fluid within annulus 52 from escaping to the atmosphere.

In an actual well installation, various wellhead configurations are possible. For example, spools 50 and 51 could be readily replaced by a single spool having two flow ports. Also, an actual well installation would probably have a master valve and a swab valve installed between the tubing hanger 60 and tubing flow spool 63.

Tubing flow spools 63 and 64 are attached to hanger 60 and contain a longitudinally bore aligned with the bore through tubing 23. Each tubing flow spool has a port allowing communication of fluid from the exterior of the spool into its longitudinal bore. Flow valve 65 can be opened to allow control fluid from a source (not shown) to enter spool 63 and flow through tubing 23 to actuating means 40. As previously noted, seal means 43 prevents control fluid from commingling with fluid flowing through lateral passageways 33 and the lower portion of bore 32. Flow valve 66 can be opened to allow kill fluids from a source not shown to be injected through spool 64 and tubing 23 to actuating means 40. As will be later described, liquids can be injected through actuating means 40 to kill the well.

Crown spool 67 and plug 68 are affixed to the top of tubing flow spool 64. Crown spool 67 has a bore 69 aligned with the bore through spools 64, 63, 51, 50 and tubing 23. Therefore, crown plug 68 can be removed and standard wireline techniques used to remove actuating means 40 from the upper portion of bore 32. As will be later described, valve closure means 34 can be locked open, actuating means 40 removed, and wireline operations conducted through the unrestricted bore 27 of tubing 23.

FIGS. 3A, 3B, 3C, 3D, 3E and 3F show surface controlled subsurface safety valve 30 of the present invention with the valve closure means 34 in its first position. Outer housing 31 consists of several tubular subsections joined by threaded connections having an o-ring seal to provide a pressure tight connection. Subsections are used to allow for ease in manufacture and assembly of the safety valve.

Nipple subassembly 31*a* provides means for making up safety valve 30 as part of tubing 23 comprising threads 71 formed near the extreme upper end of bore 32. Recesses 72 are formed within the inside diameter of nipple sub 31*a* to provide part of the means for engaging actuating means 40 within the upper portion of bore 32. Keys 73 are carried on the exterior of actuating means 40 and can be releasably engaged with recesses 72. U.S. Pat. No. 3,208,531 to J. W. Tamplen fully discloses the construction of keys 73 and methods for installing and removing a well tool such as actuating means 40 from bore 32 of safety valve 30. U.S. Pat. No. 3,208,531 is incorporated by reference for all purposes in this written description.

Actuating means 40 comprises a locking mandrel 47 which secures actuating means 40 within safety valve 30. Seal means 43 is carried on the exterior of locking mandrel 47 along with keys 73. A longitudinal bore or opening 74 extends through locking mandrel 47 and the other sections of actuating means 40. Seal means 43 forms a fluid tight seal between the exterior of actuating means 40 and bore 32 when keys 73 are engaged with recesses 72. Therefore, when safety valve 30 is connected to tubing 23 by threads 71 and actuating means 40 installed within bore 32, fluid pressure in the tubing above safety valve 30 is directed into opening 74 through lock mandrel 47.

Figure 3A:
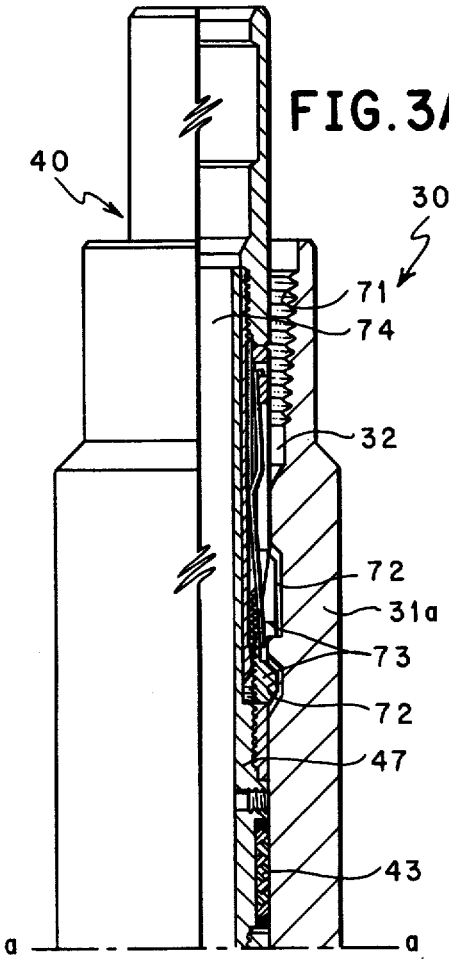
FIGS. 3A, 3B, 3C, 3D, 3E and 3F are schematic views partially in section of the well safety valve of the present invention with the valve closure means open and the actuating means installed within the upper portion of the safety valve.
Figure 3B:
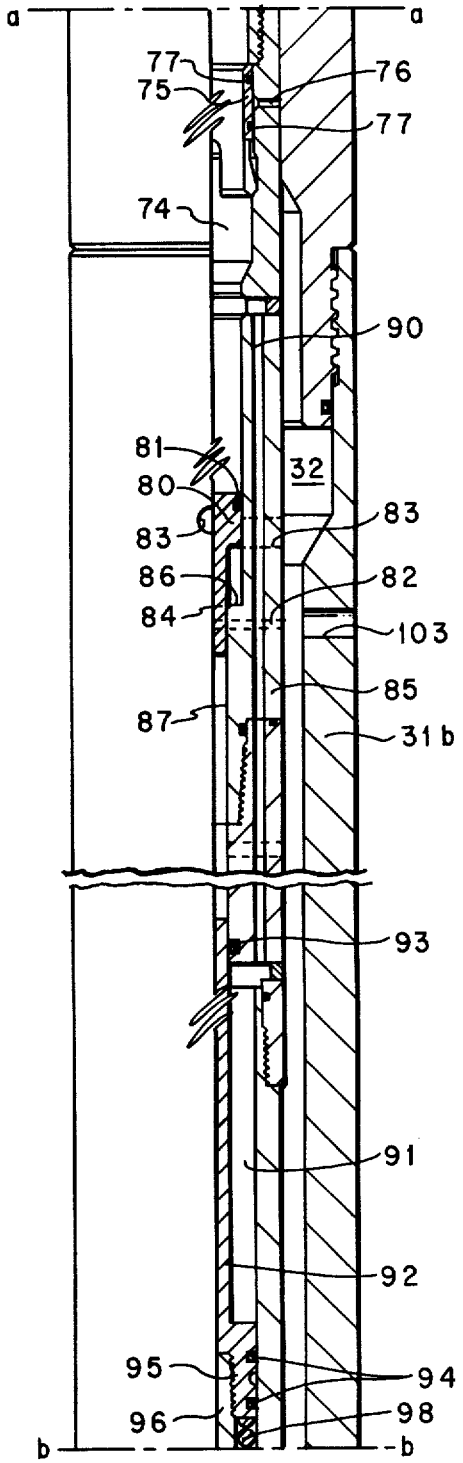

A typical tubing string may contain several landing nipples with internal profiles similar to nipple sub 31*a*. While actuating means 40 is being inserted and withdrawn through tubing 23, seal means 43 can form a seal with the restricted inside diameter of such landing nipples and hinder normal wireline operations. Port 76 penetrates the outer wall of locking mandrel 47 below seal means 43 to allow communication of fluids from the exterior of locking mandrel 47 to opening 74. Equalizing device 75 is slidably disposed within opening 74 and carries two o-rings 77 on its exterior. As shown in FIG. 3B, o-rings 77 form seals straddling port 76 to prevent fluid flow therethrough. When actuating means 40 is being installed or removed from safety valve 30, the running and pulling tool (not shown) will displace equalizing device 75 longitudinally allowing fluid flow through port 76. The running tool will shift equalizing device 75 to a position blocking fluid flow through port 76 after engaging keys 73 with recesses 72.

Actuating means 40 comprises several subassemblies, each having a concentric hollow bore forming opening 74. Each subassembly is joined by a threaded connection having an o-ring seal to provide a pressure tight joint.

As will be described later, control fluid within opening 74 can flow variable volume chamber 91. Chamber 91 is formed within the same hollow concentric bore that includes opening 74. Chamber 91 is defined by piston rod 92 slidably disposed within opening 74, fixed seal 93 sealing between piston rod 92 and opening 74, and movable seals 94 carried on the exterior of first piston means 95. Piston means 95 is an enlarged diameter portion of piston rod 92. For ease of manufacture and assembly, an actuator linkage or arm 96 is engaged by threads with piston means 95. The end of actuator linkage 96 opposite first piston means 95 is threadedly engaged with dart or actuator head 97.

When control fluid pressure is applied to chamber 91, first piston means 95 moves to its first position. Means for biasing first piston means 95 to its second position are disposed within actuating means 40. The biasing means includes spring 98 acting on first piston means 95 opposite control fluid pressure in chamber 91 and gas chamber 101 partially defined by fixed seal 102 engaged with actuator linkage 96 and moving seals 94.

When actuating means 40 is engaged with nipple subassembly 31*a*, the major portion of actuating means 40 extends through outer housing subassembly 31*b*. Subassembly 31*b* has ports 103 which are always open to allow pressure to equalize between the exterior of outer housing 31 and bore 32 below seal means 43.

Figure 3C:
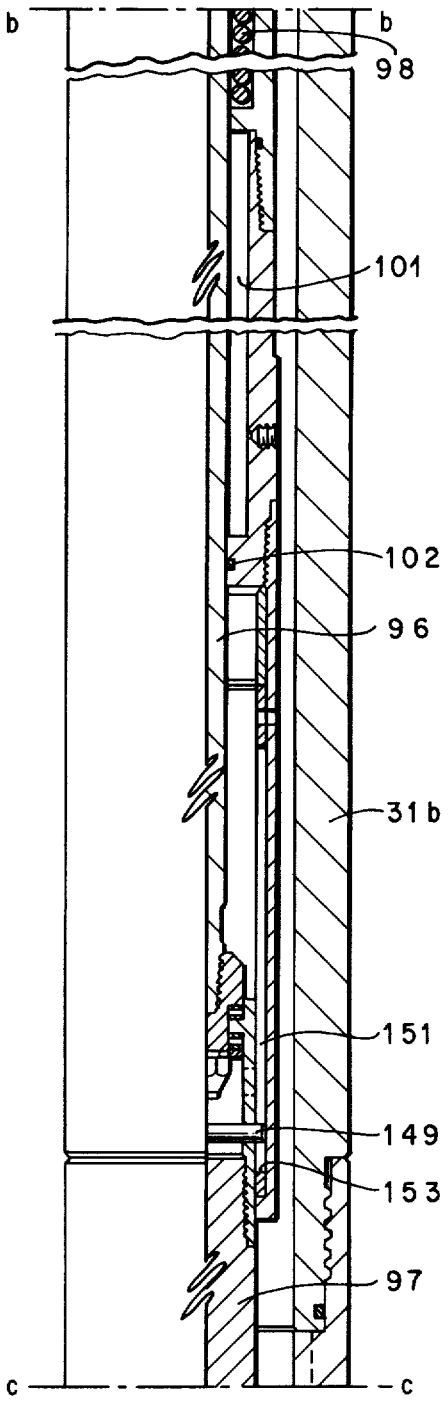
Figure 3D:
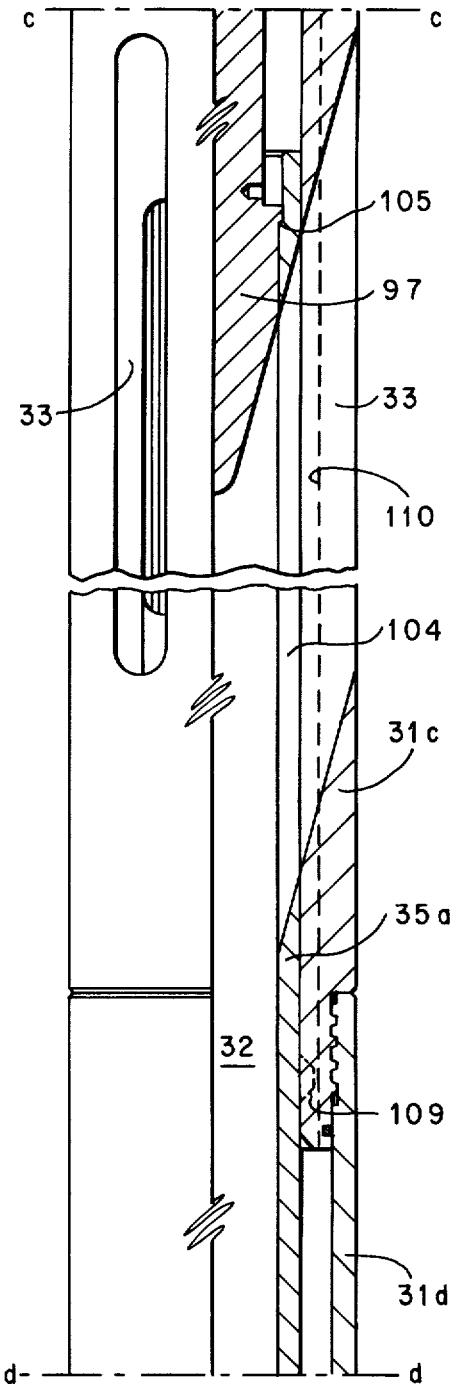
Figure 5A:
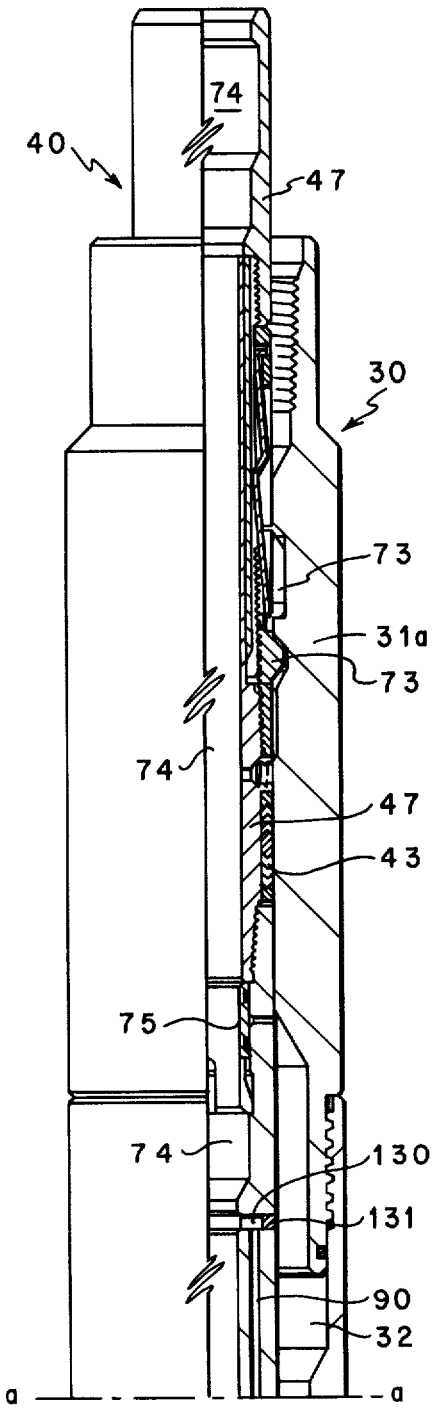
FIGS. 5A, 5B, 5C, 5D and 5E are schematic views partially in section of the well safety valve of the present invention with the valve closure means in the closed position and the actuating means installed within the upper portion of the safety valve.
Figure 5B:
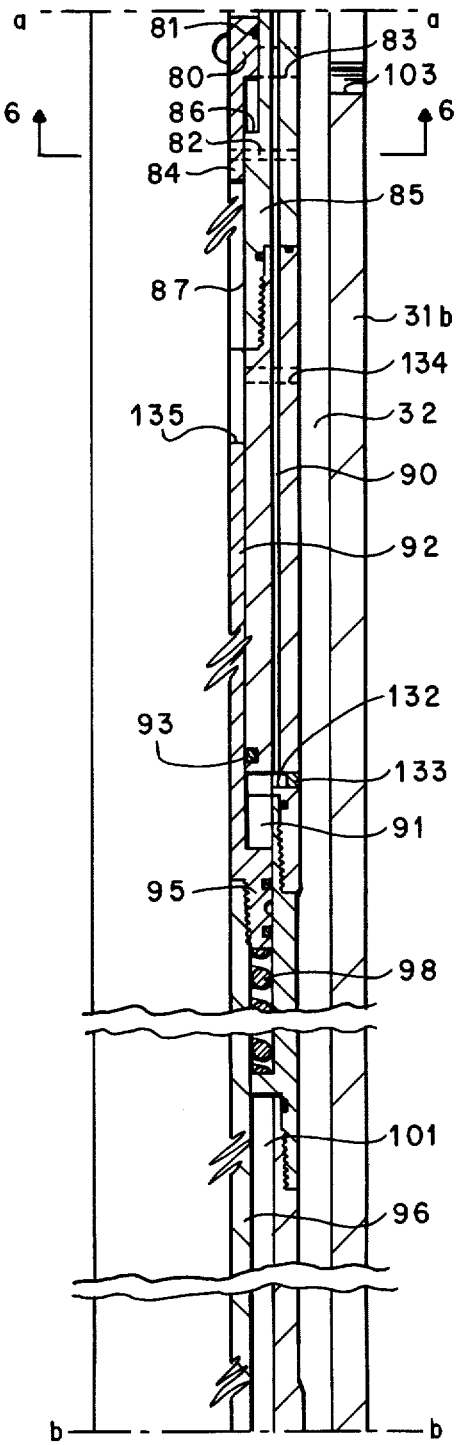
Figure 5C:
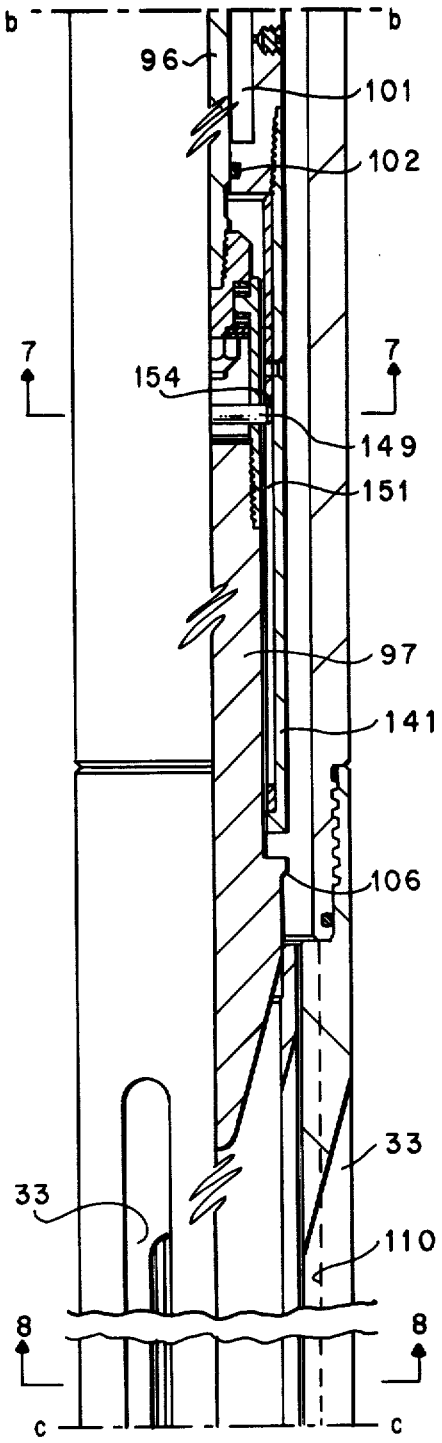
Figure 5D:
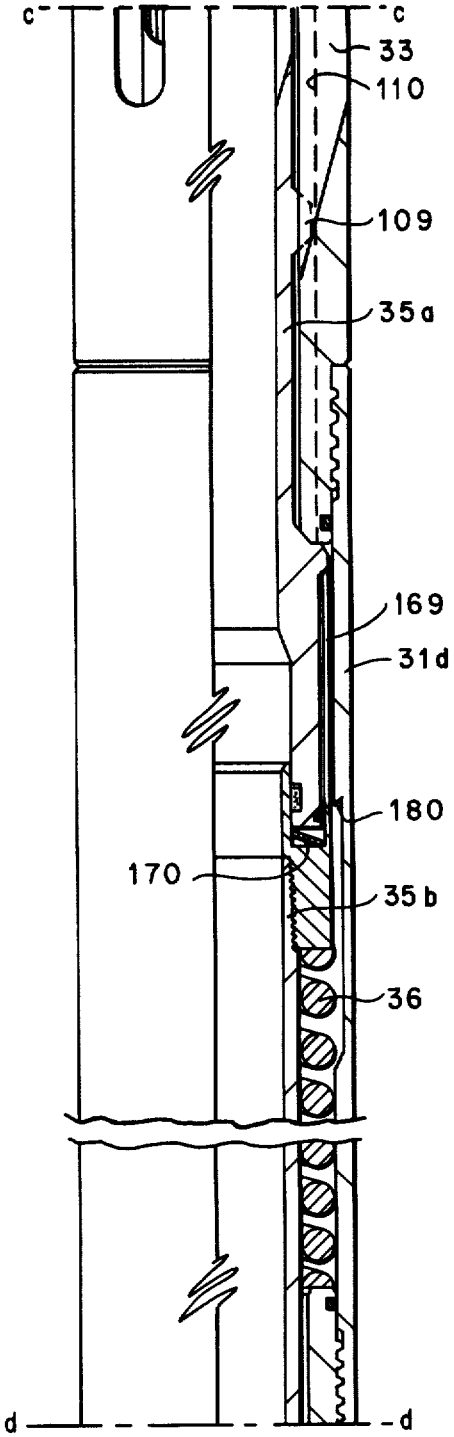

Ported subassembly 31*c* contains three lateral passageways 33 to allow fluid communication between bore 32 and the exterior of outer housing 31. As best shown in FIGS. 3D, 5C and 5D, lateral passageways 33 are designed for minimum flow resistance.

Operating tube 35 is slidably disposed within bore 32 and comprises first section 35*a* and second section 35*b*. First section 35*a* has three lateral passageways 104 which are configured to match lateral passageways 33. Shoulder 105 is formed within the inside diameter of first section 35*a* near one end thereof. Actuator head or dart 97 has a shoulder 106 formed on its outside diameter to engage shoulder 105. The exterior of dart 97 and the lateral flow passageways 104 and 33 are designed to produce minimum flow restriction when fluids are flowing into or out of bore 32 with operating tube 35 in its first position as shown in FIG. 3*d*. Key 109 is carried on the exterior of first section 35*a* and travels longitudinally within keyway 110 formed within the inside diameter of ported subassembly 31*c*. Key 109 and keyway 110 maintain the radial alignment of lateral passageways 104 and 33.

Spring housing subassembly 31*d* is threadedly engaged with port subassembly 31*c*. The inside diameter of subassembly 31*d* contains a locking recess 112 and spring 36. Operating tube sections 35*a* and 35*b* are slidably joined adjacent locking recess 112. During normal operation of safety valve 30, operating tube section 35*a* and 35*b* move in unison as a single unit. As will be later described, limited relative movement between first section 35*a* and second section 35*b* is possible to automatically lock open valve closure means 34. One end of spring 36 rests on fixed shoulder 114 on the inside diameter of subassembly 31*d*. The other end of spring 36 engages shoulder 115 formed on the outside diameter of second section 35*b*. When operating tube 35 is moved to its first position, spring 36 is compressed.

Valve housing subassembly 31*f* is threadedly engaged with subassembly 31*e*. Valve closure means 34 is shown as a flapper rotatably fixed within subassembly 31*f* by hinge assembly 116. When operating tube 35 is removed to its first position, the end of operating tube 35 opposite actuating means 40 moves flapper 34 to its first position allowing unrestricted flow through the lower portion of bore 32.

Hinge assembly 116 includes spring 117 which urges valve closure means or flapper 34 to its second position blocking flow through bore 32. Spring 36 also urges operating tube 35 to return to its second position. As shown in FIGS. 5A through 5E, when the pressure of control fluid in chamber 91 is decreased below a preselected value biasing means, including spring 98 and gas chamber 101, return first piston means and actuator linkage 96 to its second position while resilient means, including srings 36 and 117, urge valve closure means 34 from its first position to its second position.

Adapter subassembly 31*g* is threadedly connected to subassembly 31*f*. Threads 118 are carried on the exterior of subassembly 31*g* to allow safety valve 30 to be made up intermediate the ends of a tubing string.

Referring to FIGS. 5A through 5E the safety valve 30 of the present invention is shown in its closed position, blocking flow through the lower portion of bore 32. As previously described, control fluid pressure from the tubing above safety valve 30 can flow into opening 74 through drilled passageway 90 into chamber 91 to move first piston means 95. Drilled passageway 90 is connected to opening 74 by lateral drilled port 130. For ease of manufacture port 130 is drilled from the exterior of actuating means 40 into opening 74. Drilled port 130 is then sealed by welded plug 131 to prevent control fluid pressure from escaping to the exterior of actuating means 40 below seal means 43. A similar lateral driller port 132 and weld plug 133 is used to connect the lower end of drilled passageway 90 with variable volume chamber 91.

Second piston means 80 is releasably disposed within opening 74 below drilled port 130. O-ring 81, carried on the exterior of piston means 80, forms a fluid tight seal with the inside diameter of opening 74. Piston means 80 is held in its first position by shear pin 82. A shoulder 86 is formed within opening 74 spaced below piston means 80. Extension or rod 84 extending from piston 80 is slidable within the reduced inside diameter 87 forming shoulder 86. Shear pin 82 engages outside wall 85 and extension 84 to releasably hold piston 80 spaced from shoulder 86.

Lateral ports 83, shown in dotted lines, are drilled through wall 85 above shoulder 86. Lateral port 83 and drilled passage 90 are radially offset within wall 85 and do not intersect. When second piston means 80 is in its first position, seal 81 prevents control fluid pressure within opening 74 from escaping through port 83. Port 83 is located below seal means 43 and communicates the pressure of formation fluids flowing through the lower portion of bore 32 to opening 74 below second piston means 80. During normal valve operations, second piston means 80 has control fluid pressure acting on one side and formation fluid pressure on the other side.

Injecting Liquids to Kill the Well

In a gas storage well installation such as shown in FIG. 1, the control fluid is generally gas. While conducting maintenance on a well, frequently high density liquids are injected into the well bore to create a hydrostatic head greater than formation fluid pressure to prevent formation fluids from reaching the well surface. The well safety system of the present invention facilitates injecting liquids to kill the well.

Safety valve 30 is closed by bleeding off control fluid pressure from tubing 23 above actuating means 40. Biasing means, spring 98 and gas chamber 101, can move first piston means 95 to its second position as shown in FIG. 5B. If the well is to be killed with high density liquids, flow valve 66 at wellhead 24 is opened and liquid injected into tubing 23. During normal operations, the difference in pressure between control fluid and formation fluid across second piston means 80 is not enough to shear pin 82. However, the pressure of liquid injected into opening 74 can be increased enough to shear pin 82 and move second piston means 80 to its second position resting on shoulder 86. When piston means 80 is in its second position, liquids from opening 74 can flow through port 83 into bore 32 between actuating means 40 and outer housing 31 below seal means 43. Port 103 in subassembly **31*b* allows the liquid to flow from bore 32 into annulus 25 surrounding safety valve 30. Wall 85 of actuating means 40 has additional penetrations 134 spaced longitudinally from port 83. Penetrations 134 communicate fluid pressure from bore 32 to opening 74 near the extreme end 135 of piston rod 92. End 135 is subject to the same pressure as actuator linkage 96 which is the pressure of fluids within bore 32. Therefore, piston rod 92 extending through fixed seal 93 is pressure balanced with actuator linkage 96 through fixed seal 102**.

Figure 5E:
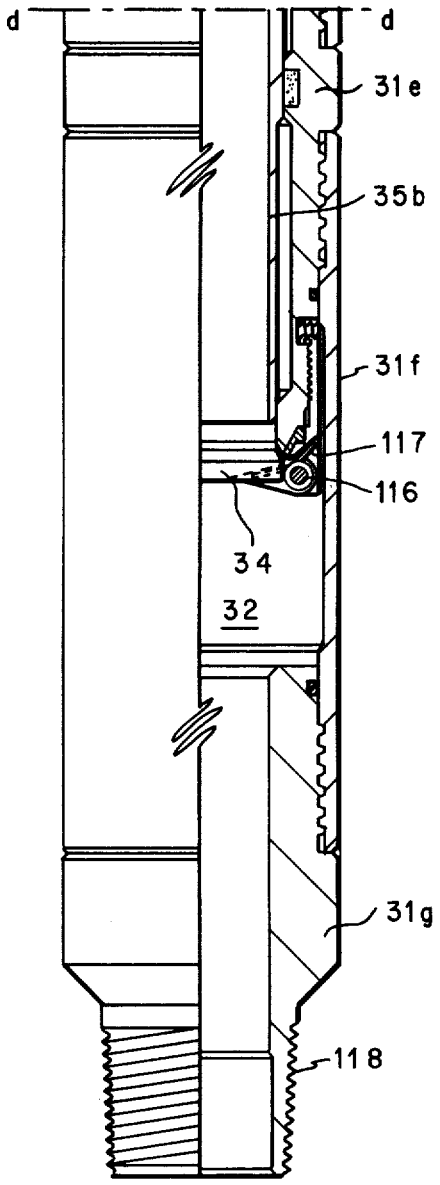
Figure 6:
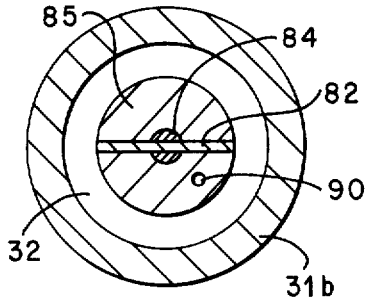
FIG. 6 is a cross section showing the shear pin holding the injection kill plug or second piston means in place within the actuating means.
Figure 7:
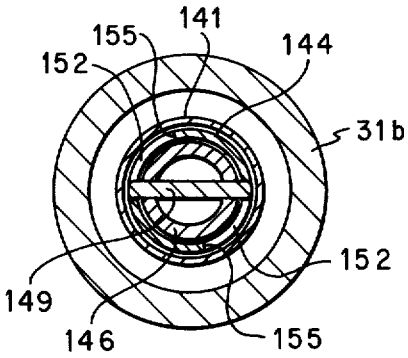
FIG. 7 is a cross section showing the guide pin for the actuator linkage at the upper end of the automatic J slots.
Figure 8:
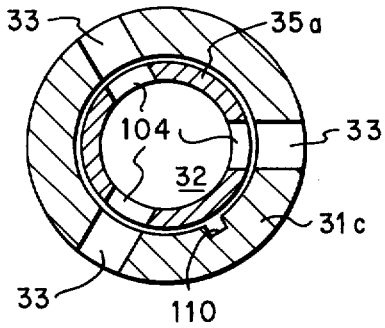
FIG. 8 is a cross section showing the lateral passageways for communication of fluid from the bore of the safety valve to the exterior thereof.

Before the pressure of liquid within opening 74 is increased high enough to shear pin 82, it will be transmitted by drill passage 90 to variable volume chamber 91 and open valve closure means 34 by acting upon first piston means 95. As previously described, shearing pin 82 allows liquid to be injected into annulus 25 through port 103. From annulus 25, liquid can flow through lateral passageways 33 and 104 into the lower portion of bore 32 past open valve closure means 34 and into bore 27 of tubing 23 below safety valve 30. If valve closure means 34 consists of the flapper, hinge means 116 and spring 117 as shown in FIG. 5E, increased liquid pressure within annulus 25 would open valve closure means 34 even though operating tube 35 had not moved to its first position.

Pressure Testing Control Fluid Conduit

Figure 9A:
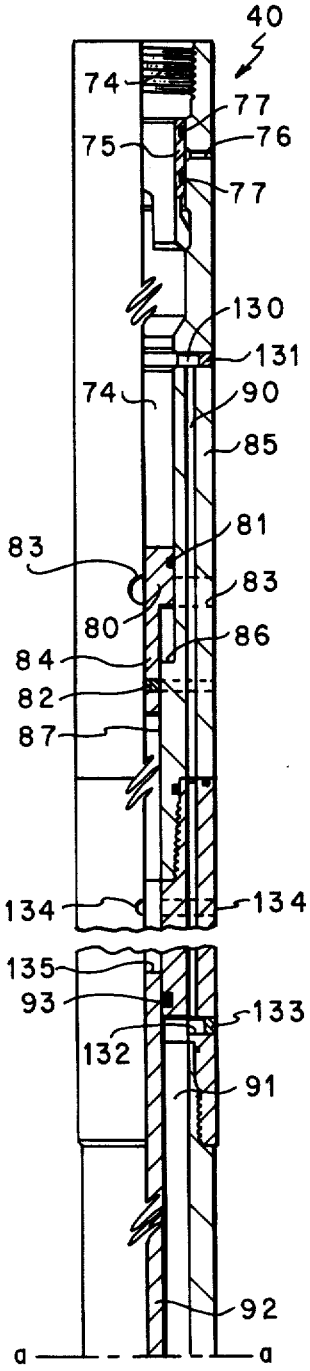
FIG. 9A, 9B and 9C are schematic views partially in section showing the actuating means with the actuator linkage extended to open the valve closure means.
Figure 9B:
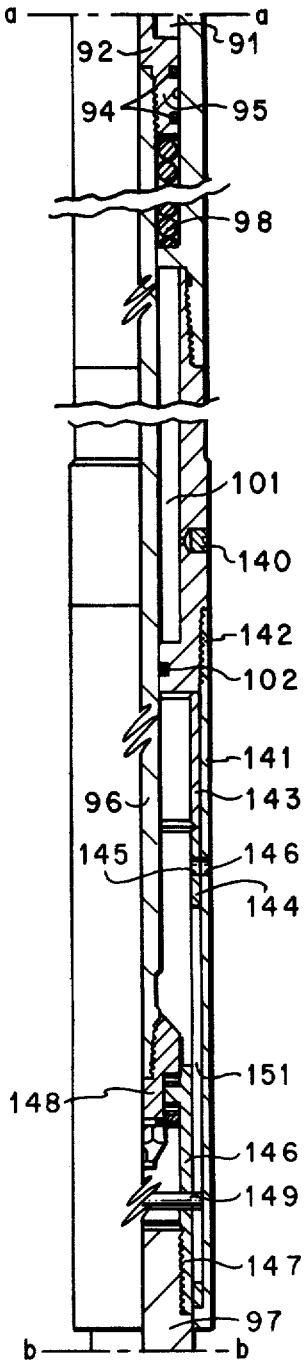
Figure 9C:
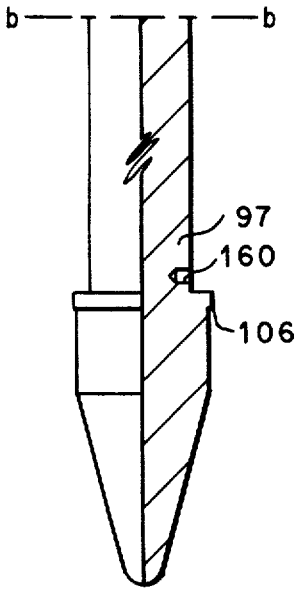
Figure 10A:
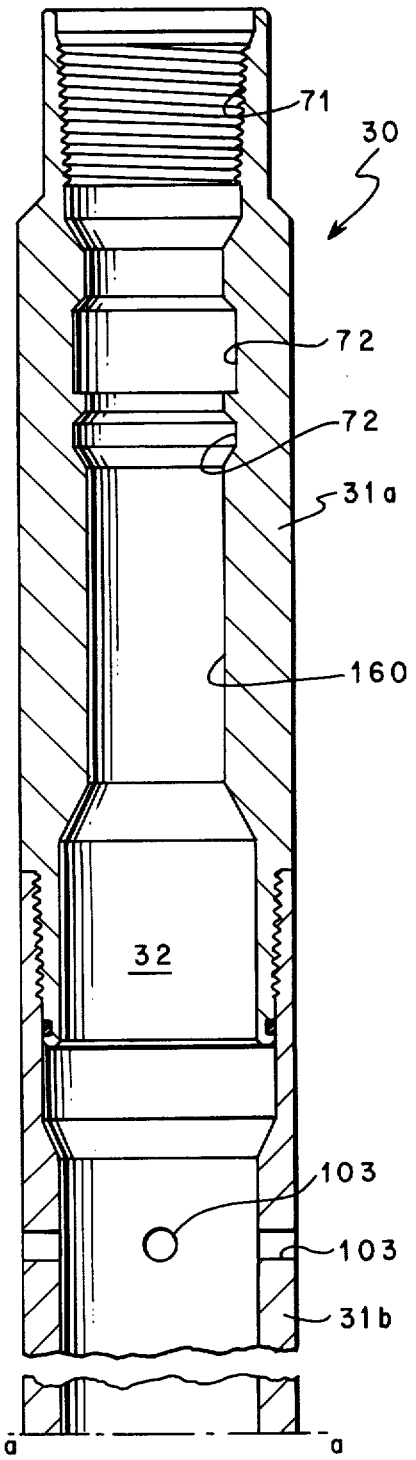
FIGS. 10A, 10B, 10C and 10D are schematic views in full section showing the safety valve of the present invention with the valve closure means locked open and the actuating means removed.
Figure 10B:
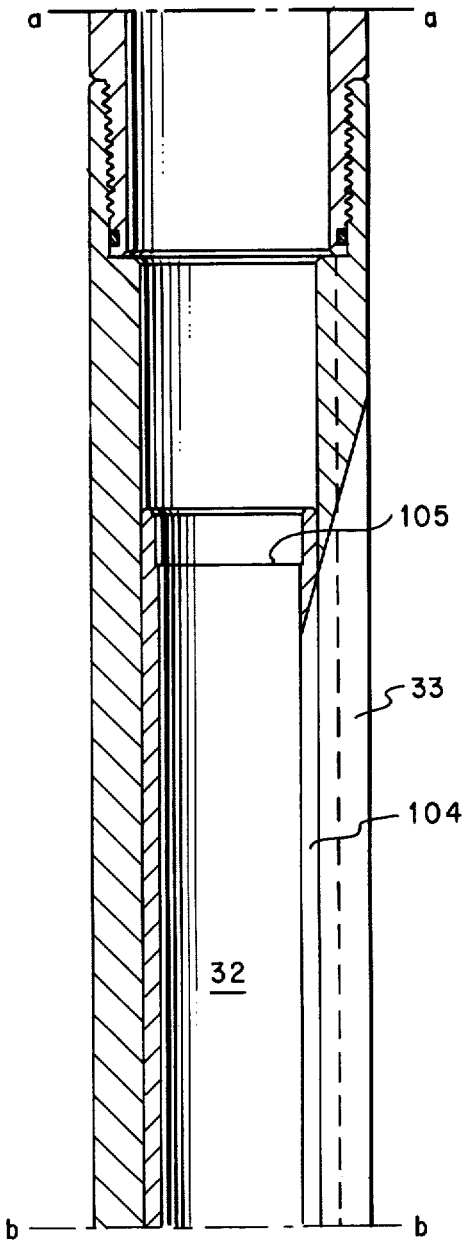
Figure 10C:
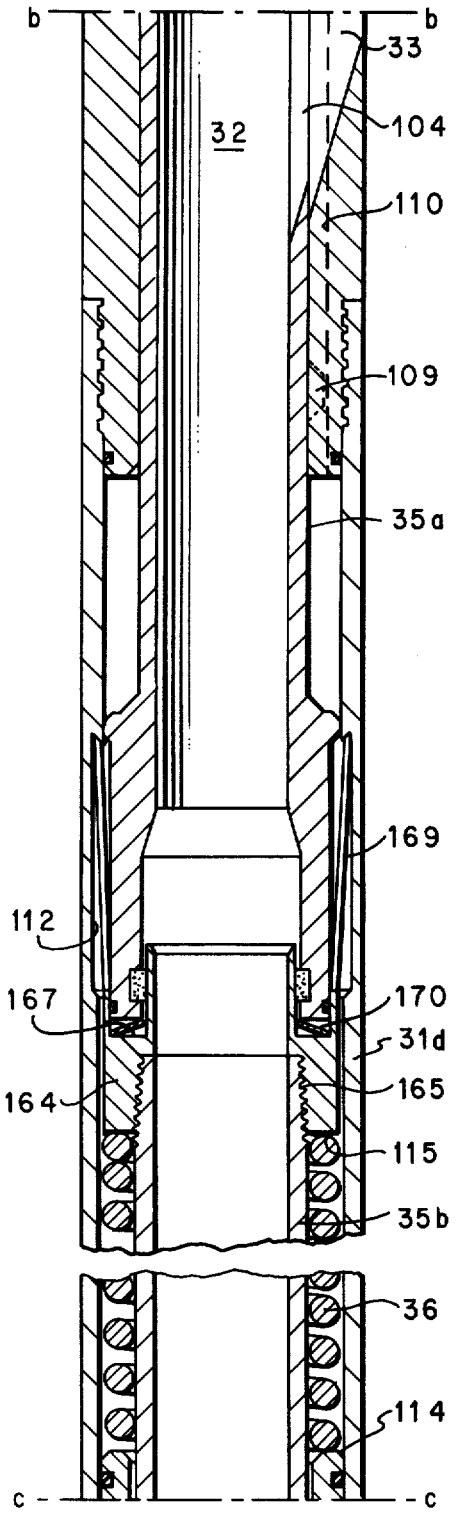
Figure 10D:
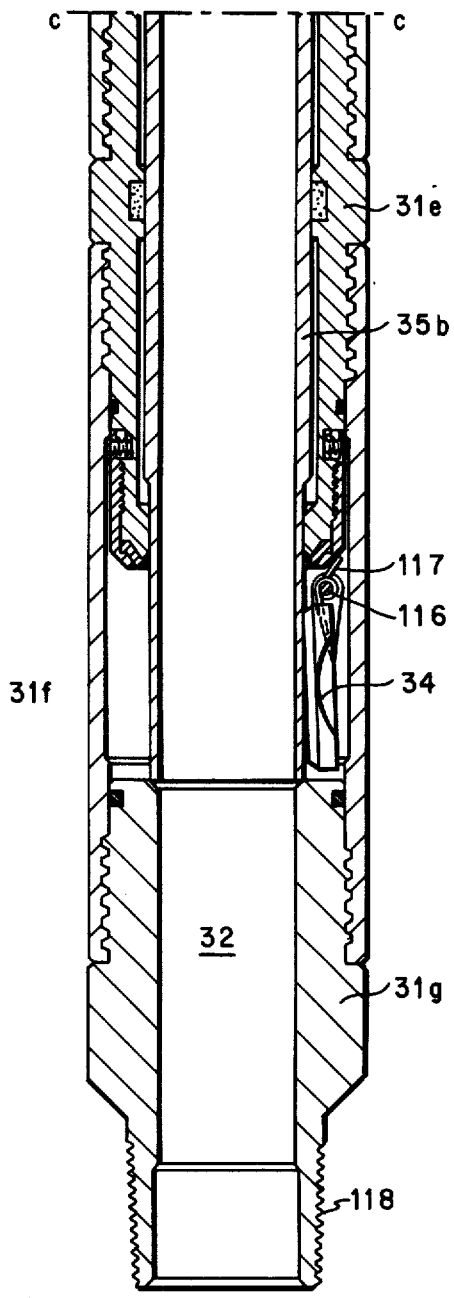

As previously noted, actuating means 40 contains means for biasing first piston means 95 to its second position. Gas chamber 101 and spring 96 comprise the biasing means. As shown in FIG. 9B, gas chamber 101 is defined by fixed seal 102, moving seals 94 on first piston means 95, the exterior of actuator linkage 96, and the inside diameter of actuating means 40. Threaded fitting 140 allows gas to be charged into gas chamber 101.

Figure 11:
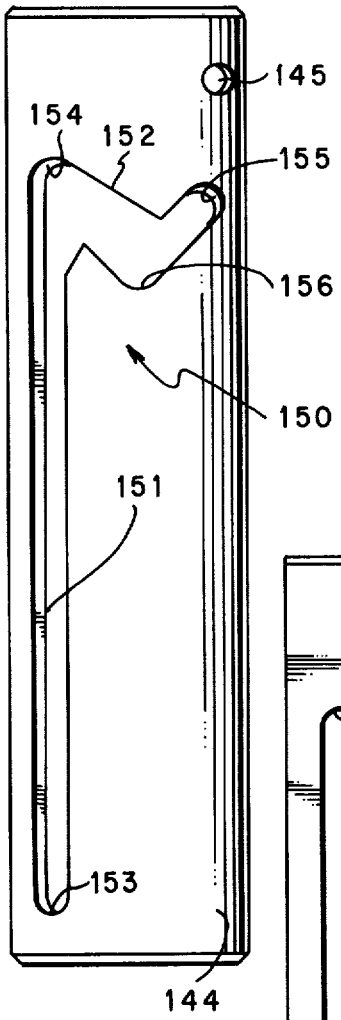
FIG. 11 is a schematic view in elevation of the tube or sleeve surrounding the actuator linkage.
Figure 12:
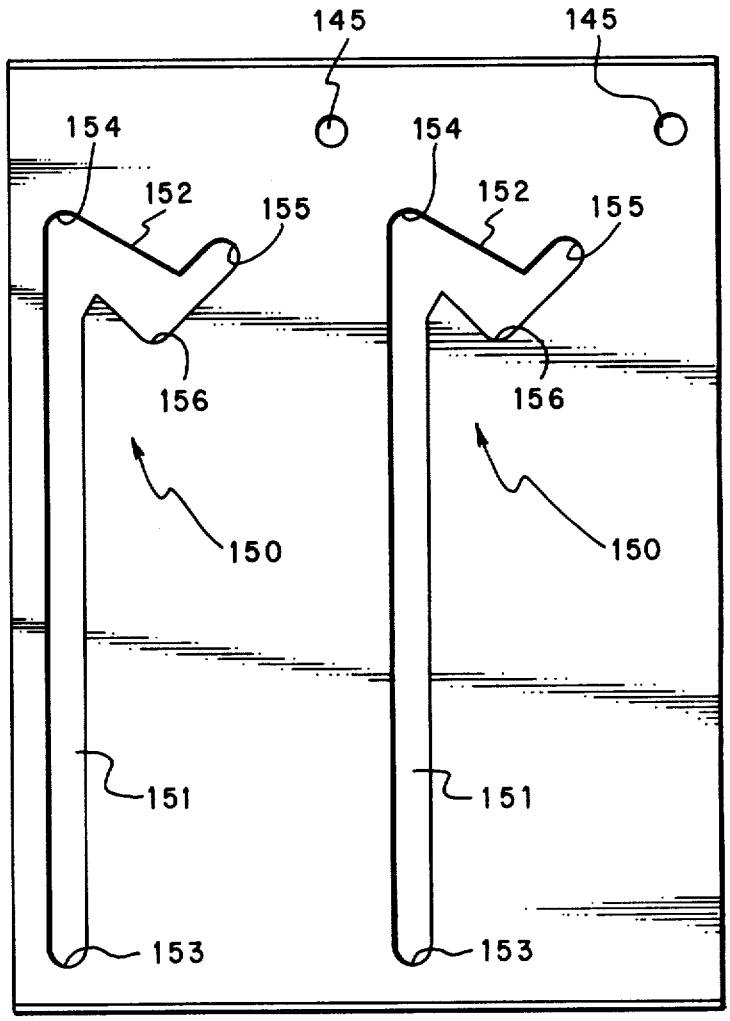
FIG. 12 is a development of the outside diameter of the tube in FIG. 11 showing the automatic J slots.

Support sleeve 141 is engaged by threads 142 to the portion of actuating means 40 containing gas chamber 101. Support sleeve 141 contains means for pressure testing actuating means 40 and the control pressure flow path from the well surface to safety valve 30 when actuating means 40 is initially installed within bore 32 without opening the valve closure means. Two concentric tubes 143 and 144 are longitudinally spaced within support sleeve 141. Both tubes 143 abd 144 and sleeve 141 are axially aligned with actuator linkage 96. Tube 143 serves as a spacer to maintain the proper position for tube 144. Tube 144 contains ports 145 which communicate with ports 146 through support sleeve 141. Tube 144 surrounds the connection between actuator linkage 96 and dart 97. Automatic J slots are machined through opposing walls of tube 144. FIG. 11 shows the exterior of tube 144 with J slots 150 and ports 145 machined therein. FIG. 12 is a development of the exterior of tube 144 showing the relationship of both J slots 150 and ports 145.

Dart 97 is engaged with cylinder 146 by threads 147. Cylinder 146 is engaged with actuator linkage 96 by bolted connection 148. Therefore, when control fluid pressure in chamber 91 moves first piston means 95 longitudinally within actuating means 40, the movement is transmitted to operating tube 35 by actuator linkage 96, bolted connection 148, cylinder 146 and dart 97.

Guide pin 149 is disposed radially through both walls of cylinder 146 and slidably engaged with J slot 150. As shown in FIGS. 11 and 12, J slot 150 includes a long longitudinal leg 151 and a shorter radial portion 152. During normal operation of safety valve 30, guide pin 149 travels through the longitudinal leg 151. When valve closure means 34 is open, guide pin 149 is near the lower end 153 of leg 151 as shown in FIG. 3C. When valve closure means 34 moves to its second position, guide pin 149 is near the upper end 154 of leg 151 as shown in FIG. 5C.

When actuating means 40 is initially assembled and prepared at the well surface for insertion into safety valve 30, dart 97 is rotated by hand to place guide pin 149 at end 155 of radial portion 152 away from leg 151. Bore hole 160 is provided in dart 97 to facilitate rotating guide pin 149 and actuator linkage 96 with a hand tool.

With guide pin 149 positioned within end 155, actuating means 40 is installed within the upper portion of bore 32. After keys 73 engage recesses 72 and seal means 43 seals with bore 32, control fluid pressure can be applied inside tubing 23 above safety valve 30. As previously described, control fluid pressure acts on first piston means 95 to move it longitudinally. However, since guide pin 149 is within end 155, guide pin 149 can only move longitudinally as far as notch 156 in radial portion 152. This limited longitudinal movement is not sufficient to allow dart 97 to contact operating tube 35. Therefore, actuating means 40 and the control fluid conduit from the well surface can be initially pressure tested for leaks without opening flapper 34.

When control fluid pressure is released from chamber 91 after the initial pressure test, the biasing means will move first piston means 95 and actuator linkage 96 to its second position. Radial portion 152 of J slot 150 is designed such that pin 149 will move to end 154 of leg 151 rather than returning to end 155. Normal valve operation is then possible with guide pin 149 in leg 151.

Locking Means

FIGS. 10A through 10D show safety valve 30 of the present invention with actuating means 40 removed and valve closure means 34 in its second position, locked open. Preferably, the upper portion of bore 32 immediately below recesses 72 has a reduced inside diameter with a smooth, honed surface 160 for forming a fluid tight seal with seal means 43.

Figure 2:
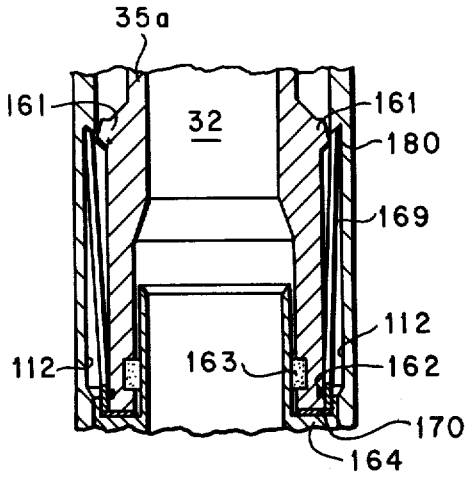
FIG. 2 is an enlarged, partial section of the valve locking mechanism.
Figure 4:
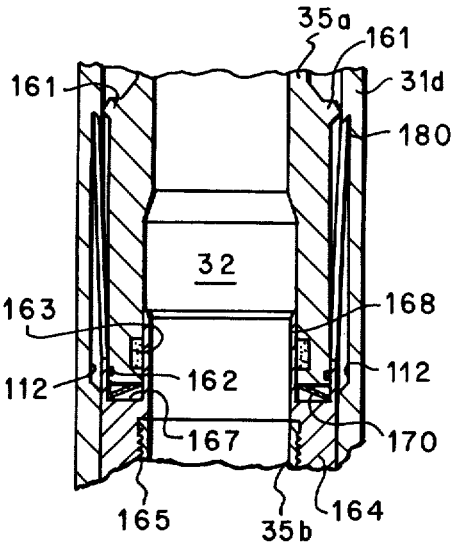
FIG. 4 is an enlarged, partial section of the valve locking mechanism.

As previously noted, operating tube sections **35*a* and 35*b* normally move as a single unit. However, limited relative longitudinal movement between the two sections is possible. Referring to FIGS. 2 and 4, the end of section 35*a*, opposite the actuator linkage, has an enlarged outside diameter forming a circular rib 161. Near the same extreme end of section 34*a*, an o-ring 162 is carried in an o-ring groove on the outside diameter. A felt wiper ring 163 is carried on the inside diameter of section 35*a* opposite o-ring 162. Felt wiper ring 163 prevents particulate contamination such as sand from being trapped between section 35*a* and 35*b***.

Figure 3E:
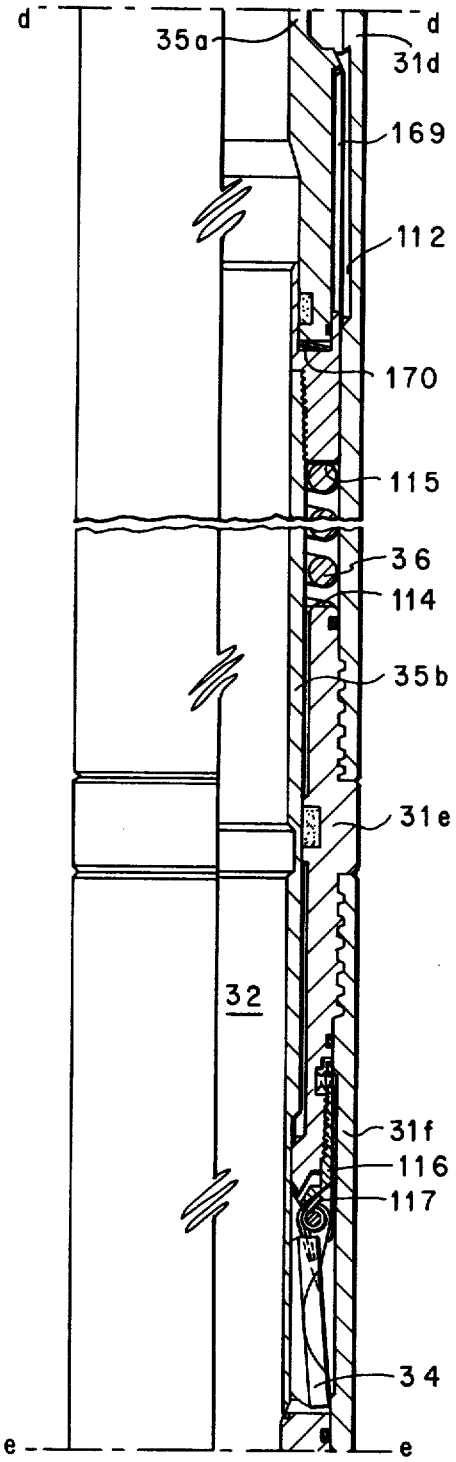
Figure 3F:
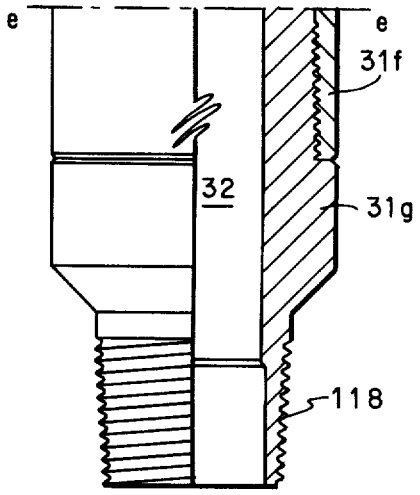

Collet lock 164 is engaged with second section **35*b* by threads 165 and forms a part of section 35*b*. Collet lock 164 contains annular groove 167 within the end of section 35*b* facing section 35*a*. A short guide tube 168 extends longitudinally from groove 167 and slides within the inside diameter of section 35*a*. Felt wiper ring 163 contacts the outside diameter of guide tube 168 to prevent sand from entering groove 167 from formation fluids flowing through bore 32. Collet fingers 169 extend from the outside diameter of groove 167 and surround the outside diameter of first section 35*a*. During normal operation, collet fingers 169 stay in close contact with the outside diameter of first section 35*a*** as shown in FIGS. 3E and 5D.

A flexible means 170 is disposed within grove 167 between the extreme end of section **35*a* and the bottom of groove 167. Flexible means 170 normally prevents sections 35*a* and sections 35*b* from moving longitudinally into abutting contact. Flexible means 170 preferably has linear deflection characteristics for the normal operating pressure present in chamber 91. However, when the pressure within chamber 91 exceeds a preselected value, flexible means 170 completely deforms as shown in FIG. 2. A Belleville spring or washer experiences these preferred characteristics and can be used for flexible means 170. As shown in FIG. 2, when flexible means 170 is completely deformed, section 35*a* can move longitudinally relative to section 35*b* resulting in rib 161 propping collet fingers 169 out into recess 112 formed on the inside diameter of subassembly 31*d*. Undercut 180 is machined into recess 112 to receive collet fingers 169. As control pressure in chamber 91 is reduced, spring 36 will move operating tube section 35*b* towards its second position before flexible means 170 can return to its initial configuration. This limited longitudinal movement securely engages collet fingers 169 with undercut 180. When control pressure in chamber 91 reaches ambient, flexible means 170 returns sections 35*a* and 35*b* to their normal spacing. However, collet fingers 169 are engaged with the outer housing 31 which holds operating tube section 35*b* in its first position locking open valve closure means 34. When normal control pressure is applied to chamber 91, operating tube sections 35*a* and 35*b* will move longitudinally enough to release collet fingers 169 from undercut 180 but not enough to completely deform flexible means 170**.

Operating Sequence

The tubing retrievable portion of safety valve 30, including outer housing 31, operating tube 35 and valve closure means 34, is installed within casing 20 as part of tubing 23. Actuating means 40 is attached to a running tool (not shown) and inserted into the upper portion of bore 32 of safety valve 30 by standard wireline techniques. With locking mandrel 47 secured within nipple subassembly **31*a*, the seals within actuating means 40, seal means 43, and the tubing above safety valve 30 can be pressure tested for any leaks by applying control fluid pressure through the bore of tubing 23. Guide pin 149 and automatic J slots 150 cooperate, as previously described, to prevent actuator linkage 96 from contacting operating tube 35 to open flapper 34. After the initial pressure test, guide pin 149 moves through legs 151 of J slots 150 for normal valve operation as the pressure in chamber 91** is varied.

Normal operation consists of applying control fluid pressure to one side of first piston means 95, overcoming the biasing means within actuating means 140, moving actuator linkage 96 longitudinally to contact operating tube 35 and open flapper 34. First section **35*a* and second section 35*b* normally move as a single unit spaced slightly apart by flexible means 170**.

Valve closure means or flapper 34 is moved to its second position blocking flow through bore 32 by resilient means comprising springs 36 and 117. When the pressure in variable volume chamber 91 drops below a preselected valve, biasing means comprising gas chamber 101 and spring 98 move first position means 95 to its second position. Spring 36 can return operating tube 35 to its second position allowing spring 117 to urge flapper 34 into its second position blocking bore 32.

During abnormal well conditions, it may be necessary to perform wireline work below safety valve 30. Normal pressure can be applied to chamber 91 to open safety valve 30. Then, control pressure in chamber 91 can be increased above a higher preselected valve to fully deform flexible means 170 allowing rib 161 to prop collet fingers 169 into recess 112. The pressure in chamber 91 is then released and spring 36 forces collet fingers 169 into firm engagement with undercut 180. Collet fingers 169 hold second section **35*b* in its first position locking open flapper 34. Actuating means 40 can be removed from bore 32 by standard wireline techniques and wireline operation below safety valve 30 conducted. Actuating means 40 can be reinstalled within bore 32, pressure tested for any leaks and normal control pressure applied to chamber 91. When actuator linkage 96 moves longitudinally through its full travel, collet fingers 169 will be released from undercut 180**.

Also, for some well conditions, it may be necessary to kill the well by injecting liquid from the surface to form a column of liquid within the wellbore having hydrostatic pressure greater than formation fluid pressure at perforations 21. Liquid can be injected into tubing 23 above safety valve 30. The pressure within opening 74 can be raised enough to shear pin 82 releasing second piston means 80 from its first position. Liquid pressure then forces second piston means 80 to engage shoulder 86 opening port 83 to the exterior of actuating means 40 and bore 32 below seal means 43. The liquid can flow by various paths including port 103 into annulus 25 between tubing 23 and casing 20. If safety valve 30 is functioning properly, operating tube 35 will open flapper 34 before pin 82 shears. If the reason for killing the well is a malfunction within safety valve 30, such as broken actuator linkage 96 or operating tube 35, liquid from port 83 can fill annulus 25 and bore 32 above flapper 34 without regard to the position of operating tube 35. When the pressure of liquid within bore 32 exceeds the pressure of formation fluids below flapper 34, flapper 34 will move off its seat allowing liquid to be injected below safety valve 30.

The previous description is only illustrative of one embodiment of the present invention for use in gas storage wells. Those skilled in the art will readily see other variations for use of the present well safety system. Changes and modifications may be made to the well safety system without departing from the scope of the invention which is defined in the claims.

What is claimed is:

1. A surface controlled subsurface safety valve for use in wells, comprising:

(a) an outer housing adapted to be made up as part of a tubing string;

(b) a longitudinal bore through the outer housing, communicating with the bore of the tubing string;

(c) a lateral passageway, intermediate the ends of the outer housing, communicating with the longitudinal bore and the exterior of the outer housing;

(d) a valve closure means disposed within the longitudinal bore between the lateral passageway and the lower end of the outer housing;

(e) the valve closure means having a first position allowing fluid flow through the longitudinal bore and a second position blocking fluid flow through the longitudinal bore;

(f) an operating tube slidably disposed within the longitudinal bore to move the valve closure means from the second position to the first position;

(g) means for resiliently urging the valve closure means from its first position to its second position;

(h) means for actuating the operating tube;

(i) means for releasably engaging the actuating means within the upper portion of the longitudinal bore;

(j) means for sealing between the exterior of the actuating means and the inside diameter of the longitudinal bore;

(k) the sealing means preventing communication of fluids from the tubing string above the safety valve with fluids flowing through the valve closure means and the lateral passageway;

(l) first piston means disposed within the actuating means;

(m) means for communicating control fluid pressure from the tubing above the safety valve to one side of the first piston means;

(n) the first piston having a first piston in which the actuating means moves the operating tube to open the valve closure means and a second position in which the resilient urging means can close the valve closure means; and (o) means for biasing the first piston means to its second position.

2. A surface controlled subsurface safety valve as defined in claim 1, further comprising:

means for locking the valve closure means in its first position when control fluid pressure acting on the first piston means exceeds a preselected value and is then released.

3. A surface controlled subsurface safety valve as defined in claim 2, wherein the locking means further comprises:

(a) the operating tube having a first section and a second section;

(b) the first section having one end adapted to engage the actuating means and the other end adapted to engage one end of the second section;

(c) the one end of the second section having an annular groove to receive the other end of the first section;

(d) flexible means for limiting the longitudinal movement of the other end of the first section within the annular groove;

(e) collet fingers extending longitudinally from the exterior of the annular groove, and normally flexed inward to contact the first section;

(f) an enlarged portion formed on the first section near the extreme end of the collet fingers;

(g) a recess formed within the inside diameter of the outer housing adjacent to the engagement between the first section and second section;

(h) the recess having at least one undercut to engage the collet fingers; and (i) the flexible means allowing the enlarged portion of the first section to prop the collet fingers of the second section outwardly into the recess when the force applied to the first section exceeds a predetermined value whereby the collet fingers can engage the undercut to releasably lock the second section in a position holding the valve closure means open.

4. A surface controlled subsurface safety valve as defined in claim 1, wherein the biasing means further comprises:

(a) a gas chamber;

(b) seal means separating the pressure of control fluid acting on the first piston means from the gas pressure within the gas chamber; and (c) spring means within the gas chamber applying force to the first piston means in the same direction as gas pressure within the gas chamber.

5. A surface controlled subsurface safety valve as defined in claim 1, wherein the actuating means further comprises:

(a) an actuator linkage which transmits movement of the first piston means to the operating tube;

(b) a cylindrical tube surrounding the actuator linkage and having automatic J slots;

(c) a guide pin extending through the actuator linkage and slidably engaged with the J slots;

(d) the first portion of the J slots having limited length whereby the actuator linkage can not move longitudinally a sufficient distance to contact the operating tube when control pressure is initially applied to the first piston means; and (e) the remainder of the J slot having sufficient length for the actuator linkage to contact the operating tube after initially applying control pressure to the first piston means.

6. A surface controlled subsurface safety valve as defined in claim 1, wherein the means for communicating control fluid pressure within the actuating means further comprises:

(a) an opening in the actuating means above the seal means to receive control fluid pressure from the tubing above the safety valve;

(b) a first passageway connecting the opening to one side of the first piston means;

(c) port means connecting the opening to the exterior of the actuator means below the seal means;

(d) second piston means releasably secured within the opening having a first position blocking control fluid pressure from the second passageway, and a second position allowing control fluid flow through the second passageway.

7. In a surface controlled subsurface safety valve having a longitudinal bore, a valve closure means disposed within the bore and having a first position allowing fluid flow through the bore and a second position blocking flow through the bore, an operating tube disposed within the bore to move the valve closure means from its second position to its first position, and means for actuating the operating tube, comprising:

(a) means for releasably engaging the actuating means within the upper portion of the longitudinal bore;

(b) means for sealing between the exterior of the actuating means and the longitudinal bore;

(c) first piston means disposed within the actuating means;

(d) means for communicating control fluid pressure from above the safety valve to one side of the first piston means;

(e) the first piston means having a first position in which the actuating means moves the operating tube to open the valve closure means and a second position allowing the valve closure means to move to its closed position;

(f) means for biasing the first piston means to its second position;

(g) an actuator linkage which transmits movement of the first piston means to the operating tube;

(h) a cylindrical tube surrounding the actuator linkage with automatic J slots;

(i) a pin extending through the actuator linkage and slidably engaging the J slots;

(j) the first portion of the J slots having limited length such that the actuator linkage can not move longitudinally a sufficient distance to contact the operating tube when control pressure is initially applied to the first piston means; and (k) the remainder of the J slots having sufficient length for the actuator linkage to contact the operating tube after initially applying control pressure to the first piston means.

8. An actuating means as defined in claim 7 wherein the biasing means further comprises:

(a) a gas chamber;

(b) first seal means separating the gas chamber from the pressure of fluid flowing through the valve closure means;

(c) second seal means separating the pressure of control fluid acting on the first piston means from gas pressure within the gas chamber; and (d) a spring within the gas chamber applying force to the first piston means in the same direction as gas pressure within the gas chamber.

9. An actuating means as defined in claim 7 wherein the means for communicating control fluid pressure further comprises:

(a) an opening within the actuating means to receive control fluid pressure from above the safety valve;

(b) a first passageway connecting the opening to one side of the first piston means;

(c) a second passageway connecting the opening to the exterior of the actuating means below the seal means;

(d) second piston means releasably secured within the opening having a first position blocking fluid flow from the tubing above the safety valve through the second passageway, and a second position allowing fluid flow from the tubing above the safety valve through the second passageway.

10. A well safety system for use in a well having casing, a wellhead supported on the casing, tubing disposed within the casing and connected to the wellhead and a packer intermediate the ends of the tubing sealing between the tubing and casing, comprising:

(a) a tubing retrievable safety valve having a bore therethrough and forming a part of the tubing string above the packer;

(b) the safety valve having lateral passageways allowing fluid communication between the bore of the safety valve and the annulus between the tubing and casing above the packer;

(c) a valve closure means installed within the safety valve to block fluid flow from the tubing below the safety valve with the bore of the safety valve;

(d) an operating tube, slidably disposed within the safety valve, having a first position opening the valve closure means and lateral passageways conforming with the lateral passageways in the safety valve;

(e) means for actuating the valve closure means in response to control fluid pressure supplied by a conduit from the well surface, the actuating means being installed and removed by wireline from the bore to the safety valve through the bore of the tubing above the safety valve;

(f) the conduit for supplying control fluid pressure to the valve actuating means comprising the tubing above the safety valve;

(g) means for locking the valve closure means open in response to control fluid pressure and unlocking the valve closure means in response to control fluid pressure;

(h) means for injecting liquid from the well surface through the tubing and the valve actuating means to kill the well;

(i) means for pressure testing the control conduit when the valve actuating means is initially installed within the bore of the safety valve without opening the valve closure means;

(j) the locking means further comprising an operating tube to open the valve closure means, the operating tube having a first section engaged by the valve actuating means and a second section engaging the valve closure means;

(k) the first and second sections being operatively coupled by the locking means;

(l) flexible means installed between the first section and the second section having deformation characteristics which allow the second section to move in unison with the first section until a preselected value of force is exceeded allowing the first section to move relative to the second section;

(m) a rib formed on the exterior of the first section and spaced longitudinally from the flexible means;

(n) collet fingers projecting longitudinally from the second section and surrounding the exterior of the first section;

(o) the spacing between the rib and the collet fingers selected such that the rib will prop the collet fingers outward when the flexible means allows relative movement between the first section and the second section;

(p) a recess formed within the bore of the safety valve adjacent the coupling of the first section and the second section; and (q) the recess having an undercut engageable with the collet finger when propped outward by the rib, whereby the collet fingers engage the recess to hold the second section within the bore of the safety valve locking the valve closure means open.

11. A well safety system as defined in claim 11, wherein the injecting means further comprises:

(a) a second piston means releasably secured within the bore of the actuating means;

(b) means for sealing between the second piston means and the bore to form a fluid tight barrier;

(c) a lateral port below said sealing means communicating the bore of the actuating means with the exterior thereof; and (d) the second piston means having two positions, the first blocking communication of fluid from the tubing above the safety valve with the exterior of the actuating means and the second allowing communication of fluid between the tubing above the safety valve and the exterior of the actuating means.

12. A well safety system as defined in claim 10, wherein the pressure testing means further comprises:

(a) a cylindrical tube having automatic J slots;

(b) a pin extending through the actuator linkage and slidably engaged with the J slots;

(c) the length of the radial portion of the J slots limited such that the actuator linkage can not move longitudinally a sufficient distance to contact the operating tube for the valve closure means; and (d) the leg of the J slots having sufficient length for the actuator linkage to contact the operating tube after initial pressure testing of the control conduit.

13. A surface controlled subsurface safety valve for use in a gas storage well having casing, a wellhead, tubing disposed within the casing and connected to the wellhead and a packer intermediate the ends of the tubing and forming a seal between the tubing and casing, comprising:

(a) an outer housing adapted to be made up as part of the tubing;

(b) a longitudinal bore through the outer housing and communicating with the bore of the tubing;

(c) a lateral passageway, intermediate the ends of the outer housing, communicating with the longitudinal bore and the exterior of the outer housing;

(d) recesses formed within the longitudinal bore near one end of the outer housing;

(e) a valve closure means disposed within the longitudinal bore between the lateral passageway and the other end of the outer housing;

(f) the valve closure means having a first position allowing fluid flow through the longitudinal bore and a second position blocking flow through the bore;

(g) an operating tube slidably disposed within the longitudinal bore to move the valve closure means from the second position to the first position;

(h) means for resiliently urging the valve closure means from its first position to its second position;

(i) means for actuating the operating tube;

(j) keys carried on the exterior of the actuating means to releasably engage with the recesses in the longitudinal bore;

(k) means for sealing between the exterior of the actuating means and the longitudinal bore when the keys are engaged with the recesses;

(l) the sealing means preventing communication of fluids from the tubing above the safety valve with fluids flowing through the valve closure means and the lateral passageway;

(m) first piston means disposed within the actuating means and responsive to control fluid pressure changes within the tubing above the safety valve;

(n) an actuator linkage transmitting movement of the first piston means to the operating tube; and (o) the first piston means having a first position in which the operating tube opens the valve closure means and a second position in which the resilient urging means can close the valve closure means.

14. A surface controlled subsurface safety valve as defined in claim 12, further comprising:

means for locking the valve closure means in its first position when the actuating means is removed from the longitudinal bore.

15. A surface controlled subsurface safety valve as defined in claim 14, wherein the locking means further comprises:

(a) the operating tube having a first section and a second section;

(b) the first section having one end adapted to engage the actuating means and the other end adapted to engage one end of the second section;

(c) the one end of the second section having an annular groove to receive the other end of the first section;

(d) means for limiting the longitudinal movement of the first section within the annular groove;

(e) collet fingers formed on the exterior of the annular groove and normally flexed inward to contact the first section;

(f) an enlarged portion formed on the first section adjacent to the extreme end of the collet fingers; and (g) an enlarged diameter portion formed within the longitudinal bore adjacent to the engagement between the first section and second section;

(h) the enlarged diameter portion having at least one undercut formed to engage the collet fingers;

(i) the movement limiting means allowing the enlarged portion of the first section to prop the collet fingers of the second section outwardly into the enlarged diameter portion when the force applied to the first section exceeds a predetermined value whereby the collet fingers can engage the undercut to releasably lock the second section in position to hold the valve closure means opens.

16. A surface controlled subsurface safety valve as defined in claim 13 wherein the actuating means further comprises:

means for biasing the first piston means to its second position when control fluid pressure decreases below a preselected value.

17. A surface controlled subsurface safety valve as defined in claim 16, wherein the biasing means further comprises:

(a) a gas chamber;

(b) first seal means separating the gas chamber from the pressure of fluid flowing through the valve closure means;

(c) second seal means separating the pressure of control fluid acting on the first piston means from the gas chamber; and (d) a spring within the gas chamber applying force to the first piston means in the same direction as gas pressure within the gas chamber.

* * * * *